US007124545B1

(12) United States Patent
Poma et al.

(10) Patent No.: US 7,124,545 B1
(45) Date of Patent: Oct. 24, 2006

(54) TILT-UP PANEL AND METHOD

(76) Inventors: Frank Poma, 12212 Riverbend Ct., Port St. Lucie, FL (US) 34984; Jason F. Poma, 12212 Riverbend Ct., Port St. Lucie, FL (US) 34984

( * ) Notice: Subject to any disclaimer, the term of this patent is extended or adjusted under 35 U.S.C. 154(b) by 322 days.

(21) Appl. No.: 10/064,075

(22) Filed: Jun. 7, 2002

(51) Int. Cl.
*E02D 27/00* (2006.01)

(52) U.S. Cl. ..... 52/293.3; 52/293.1; 52/295; 52/309.16; 52/309.17

(58) Field of Classification Search ..... 52/125.2, 52/309.16, 309.17, 396.1, 293.1, 293.3, 295
See application file for complete search history.

(56) References Cited

U.S. PATENT DOCUMENTS

| | | | | |
|---|---|---|---|---|
| 2,200,636 | A * | 5/1940 | Palmer | 52/293.1 |
| 2,772,560 | A | 12/1956 | Neptune | |
| 3,040,393 | A * | 6/1962 | Dailey | |
| 3,609,935 | A | 10/1971 | Thomas | |
| 3,710,527 | A * | 1/1973 | Farebrother | 52/236.7 |
| 3,755,982 | A * | 9/1973 | Schmidt | 52/295 |
| 4,362,427 | A * | 12/1982 | Mass et al. | 404/64 |
| 4,442,648 | A * | 4/1984 | Reece | 52/468 |
| 4,532,745 | A * | 8/1985 | Kinard | 52/251 |
| 4,659,057 | A | 4/1987 | Felter | |
| 4,669,240 | A * | 6/1987 | Amormino | 52/236.6 |
| 4,815,886 | A * | 3/1989 | Madsen | 403/28 |
| 4,899,498 | A * | 2/1990 | Grieb | 52/144 |
| 4,903,450 | A * | 2/1990 | Adams | 52/293.2 |
| 5,111,628 | A * | 5/1992 | Desjoyaux et al. | 52/169.7 |
| 5,491,948 | A | 2/1996 | Harris | |
| 5,566,521 | A * | 10/1996 | Andrews et al. | 52/606 |
| 5,588,272 | A | 12/1996 | Haponski | |
| 5,609,005 | A | 3/1997 | Schierloh et al. | |
| 5,619,829 | A * | 4/1997 | Tan et al. | 52/293.3 |
| 5,806,273 | A | 9/1998 | Kaminski et al. | |
| 5,864,999 | A | 2/1999 | Wallin | |
| 5,893,241 | A | 4/1999 | Schroeder | |
| 5,913,793 | A | 6/1999 | Hills | |
| 5,956,912 | A * | 9/1999 | Carter et al. | 52/396.02 |
| 6,009,677 | A | 1/2000 | Anderson | |
| 6,044,614 | A | 4/2000 | Bryant | |
| 6,067,757 | A | 5/2000 | Olson et al. | |
| 6,131,365 | A * | 10/2000 | Crockett | 52/794.1 |
| 6,182,416 | B1 | 2/2001 | Brackin | |
| 6,192,639 | B1 * | 2/2001 | Germain | 52/293.1 |
| 6,244,005 | B1 * | 6/2001 | Wallin | 52/293.1 |
| 6,594,963 | B1 * | 7/2003 | Bennett | 52/293.1 |

* cited by examiner

*Primary Examiner*—Jeanette Chapman
*Assistant Examiner*—Yvonne M. Horton
(74) *Attorney, Agent, or Firm*—Malin, Haley & DiMaggio, P.A.

(57) ABSTRACT

A method for using tilt-up panels with chamfered sides, extensions below the panels ad receptacles for removable eyelets approximately ⅔ of the way up the panel. Inserts may be used between the panels to hold epoxy or other materials. The inserts may include a T-shaped form that obviates the need for caulking between the outside portions of the panels.

15 Claims, 6 Drawing Sheets

TILT-UP PANEL AND METHOD

BACKGROUND OF INVENTION

1. Field of the Invention

This invention relates generally to building construction procedures and equipment, and more particularly to a tilt-up concrete wall panel and a method for using it.

2. Description of Related Art

Tilt-up concrete wall panels are well known in the art. They facilitate building construction in the prior art, in which workers fabricate the panels at the building site and tilt them up into position to form the walls. Concrete wall panels of this type are generally limited in size because the stress of placement of these walls may cause them to break or crumble during the lifting process.

There are several disadvantages associated with tilt-up panels as they presently are used. During construction, structures formed by tilt-up panels are subject to being destabilized. Also, because panels in the present art are structurally deficient and cannot stand the rigors of transport, they must be manufactured on the construction site. The structural deficiency also prohibits the use of tilt-up panels for tall structures. In addition, current structures made with tilt-up panels may be subject to shearing forces that can weaken a structure. Moreover, there are no tilt-up panels which are designed to provide spacing for material to fill between tilt-up panels. Also, there are no tilt-up panels which use weld plates on the top, sides and bottom which may be used to provide increased support in a resulting structure. In addition, joints covers are not used which can protect seams between panels.

There is also a need for a panel specifically made to optimize the accommodation of an insert between tilt-up panels. The inserts help stabilize the panels, reduce the amount of shear on the panels, and serve as a plug between the panels so that an appropriate material may be filled between two panels. The inserts also may operate to serve as a gasket against water intrusion and an expansion joint between panels. Also, there is a need for a panel that has receptacles for removable lifting means, such as eyelets, as well as extensions below the panels, to allow large panels to be accurately placed during construction of a structure. In addition, there is a need for a panel with pre-constructed block-outs to allow conduit to run within support columns of a structure. Also, there is a need for panels with increased reinforcement within the inner side of support columns. The reinforcement would allow lifting means in mechanical communication with the increased reinforcement to be able to lift a panel without bending, weakening or breaking the panel. There is also a need for panels with weld plates on the sides so that adjacent panels may be securely welded together. There is also a need for a panel with increased strength so that the panels may reliably be manufactured off-site and transported to the construction site. Conventional tilt-up panels have not had these features which would improve the reliability of structures, increase the number of uses for tilt-up panels in the construction industry, decrease cost of production and increase speed of construction.

It may also be desirable with the construction of some buildings by tilt-up concrete wall panels to provide for a system with block-outs for running conduit throughout it. U.S. Pat. No. 6,182,416 to Brackin discloses a method for fabricating a tilt-up concrete wall panel at the building with removes that require nail holes to be placed in a concrete slab. U.S. Pat. No. 5,609,005 to Schierloh, et al., teaches a tilt-up panel with an offset anchor secured into the foundation for the structure. U.S. Pat. No. 4,659,057 to Felter teaches a system for forming concrete tilt-up wall panels that are lifted from points on the outer surface of the support columns, providing a design prone to crumbling.

In new construction, tilt-up wall panels are used for a variety of applications where the walls are relatively low. What is needed in the art is a tilt-up panel that is strong and sturdy enough to be manufactured off site and used for tall structures. A need exists for a panel for forming a structure with enhanced ability to resist shearing forces and improved expansion joints. A need also exists for a panel lifting system to allow long panels to be placed properly in forming a structure. A need also exists for a panel with block-outs for conduit and intrinsic structure for attaching drywall. Also, a need exists for a tilt-up wall system that uses an insert between panels and a joint cover at seams. It is therefore, to the effective resolution of the aforementioned problems and shortcomings of the prior art that the present invention is directed.

SUMMARY OF INVENTION

In accordance with these and other objects which will become apparent hereinafter, the instant invention will now be described with particular reference to the accompanying drawings.

DETAILED DESCRIPTION

Figure 1:
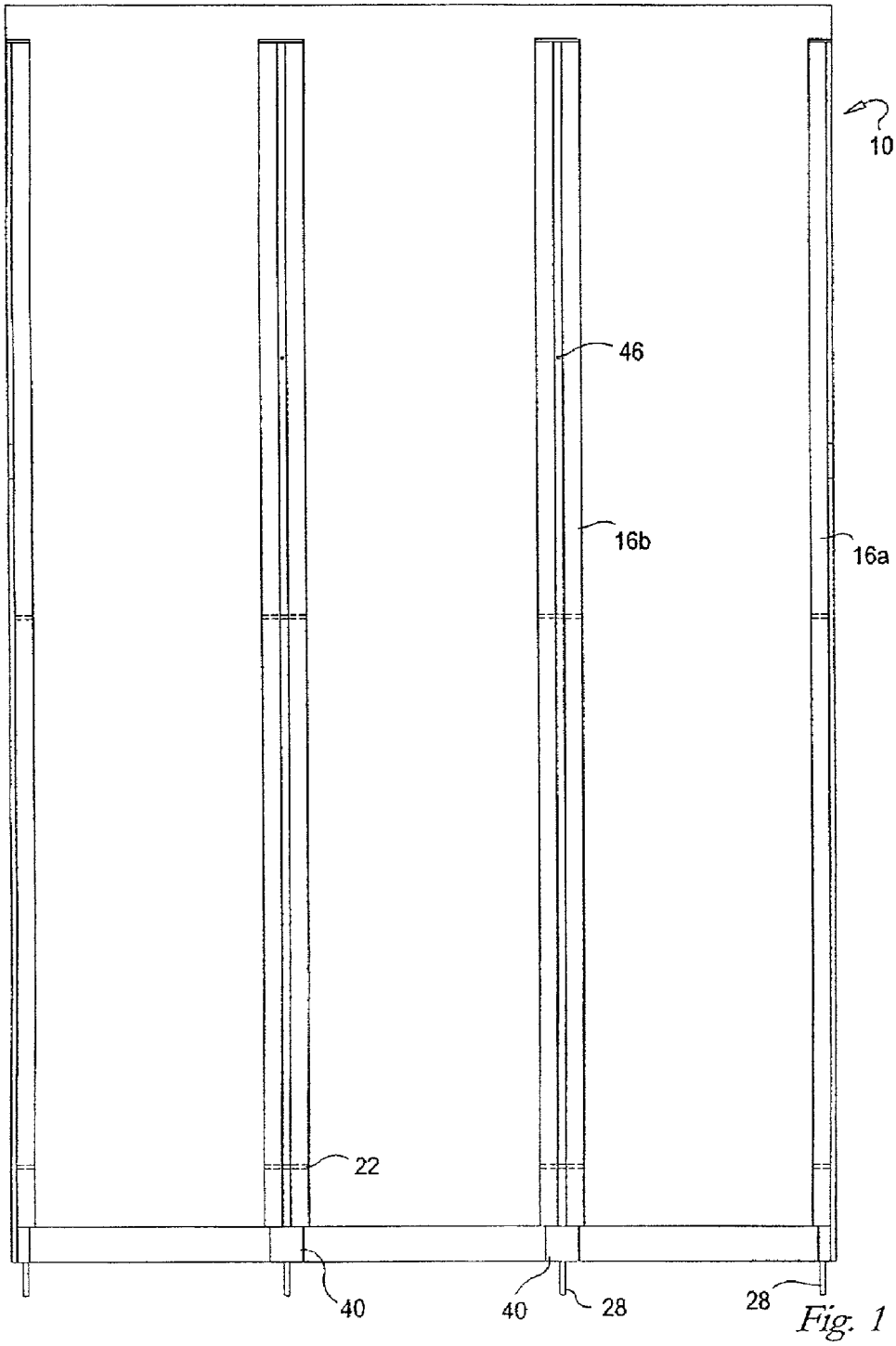
FIG. 1 is a front elevation view of the preferred embodiment of the invention.
Figure 2:
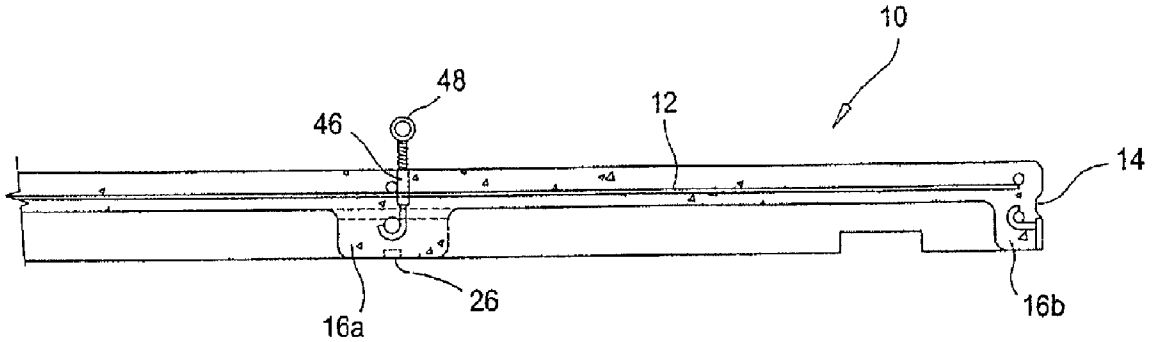
FIG. 2 is a cross sectional top view of the invention.
Figure 5:
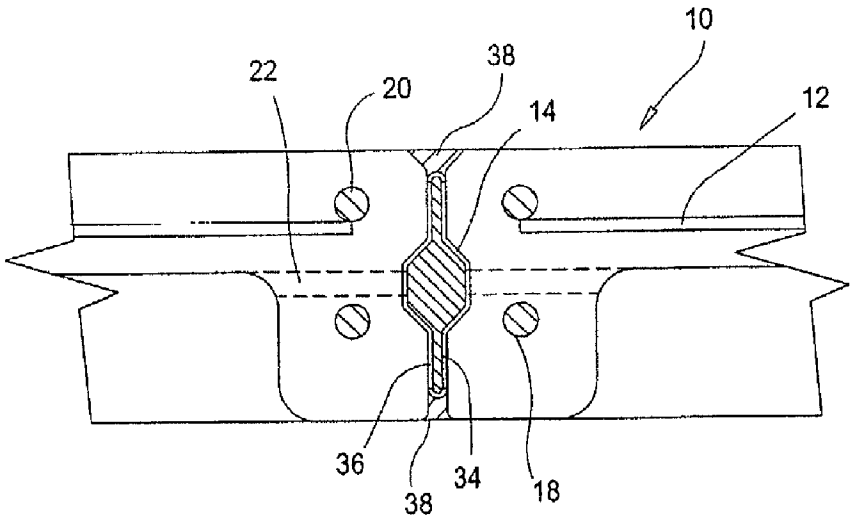
FIG. 5 is a cross sectional top view of one embodiment of the invention with an insert between the panels.

The present invention is a panel for tilt-up wall construction of a high strength structure, shown generally at 10 in FIGS. 1 and 2. The panel 10 is preferably made of concrete, approximately twelve feet long and about thirty feet high. As shown in FIG. 2, each panel is preferably reinforced by wire mesh 12. It is preferred that the mesh is 6×6×4–4, and made of iron. The concrete panel 10 formed around the mesh 12 is approximately three inches in depth. Furthermore, it is preferred that each side of the panel 10 comprises a chamfered edge 14, as shown in FIG. 5.

Each panel also includes intrinsic columnar supports 16*a*, 16*b*. As shown in FIG. 2, it is preferred that a panel 10 has at least one interior columnar support 16*a* and an exterior columnar support 16*b* on each side. The supports 16*a*, 16*b* generally run the height of the panel 10.

The columnar supports 16*a*, 16*b* are each reinforced internally by a means for reinforcing the supports centrally, preferably by one or more metal reinforcement bars 18, 20 generally running the height of each columnar support 16*a*, 16*b*. As shown in FIG. 2, preferably, in each columnar support 16*a*, 16*b* of each panel 10 is at least an inner bar 18 and an outer bar 20. However, additional bars may be preferred for additional strength. In the preferred embodiment, for the interior columnar supports 16*a*, it is preferred that the inner bar 18 is especially strong and is rigid for improved strength during the tilt-up operation. For example, in the preferred embodiment the inner bar 18 is #8 rebar, and the outer bar 20 is #6 rebar. However, for the outer column supports 16*b*, which do not bear the stresses of the inner columnar supports 16*a* during the tilt-up operation, both the inner bar 18 and the outer bar 20 may be the same strength, such as #6 rebar. It is preferred that the columnar supports 16*a*, 16*b* are about three and ⅝ inches deep and approximately eight inches wide, to accommodate framing for drywall and insulation in the interior of the structure. Furthermore, this configuration forms areas for the placement of insulation, if wanted, and drywall or other interior finishing material, removing the need for a furring strip for the drywall or other finishing material. In this configuration, the insulation is preferred to be R11 fiberglass insulation. However, other insulation may be used in the alternative.

Also, it is preferred that panel 10 comprise a receptacle 46 for a removable means for lifting the panel 10 and for facilitating placement of the panel, located approximately two-thirds up the height of the panel 10, on interior columnar supports 16*a*. However, depending upon the size of the panel used, the type and number of cutouts in the panel, and other construction factors, the height of the receptacle may be adjusted. Preferably, the receptacle 46 is a fitting for a removable eyelet 48, as shown in FIGS. 1 and 2. Preferably the receptacle 46 and the eyelet 48 have corresponding threads.

It is also preferred that the columnar supports 16*a*, 16*b* comprise one or more block-outs 22 for conduit to run. Optimally, the block-outs 22 are located approximately sixteen inches above the bottom side of the, panel 10. The block-outs may run through the exterior columnar supports 16*a*, as well as the interior columnar supports 16*b*. For panels 10 of approximately thirty feet in height, a separate set of block-outs 22 may be formed approximately thirteen feet above the bottom of the panel, as shown in FIG. 1. Among other reasons, this distance optimizes the location of conduit such as telephone cable or electrical wiring to be run on a second floor to the finished structure. Other block-outs 22 may be made into the columnar supports 16*a*, 16*b*, depending upon the use of the structure. Also, one or more stud embeds 26 may be formed in the interior and exterior columnar supports 16*a*, 16*b*, as shown in FIG. 2. These embeds 26 optimize attachment points for drywall onto the inside surface of the panel 10.

Figure 3:
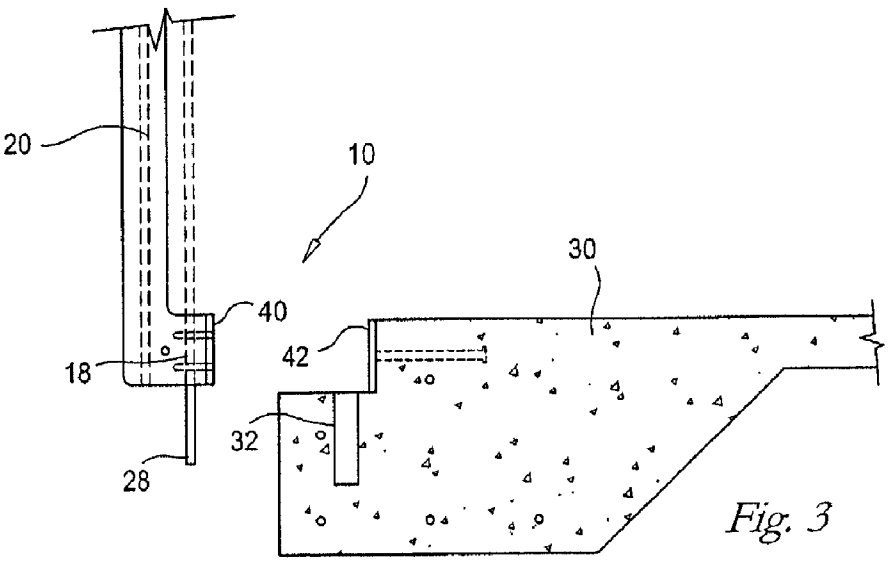
FIG. 3 is a cross sectional side view of the lower portion of the preferred embodiment of the invention.
Figure 4:
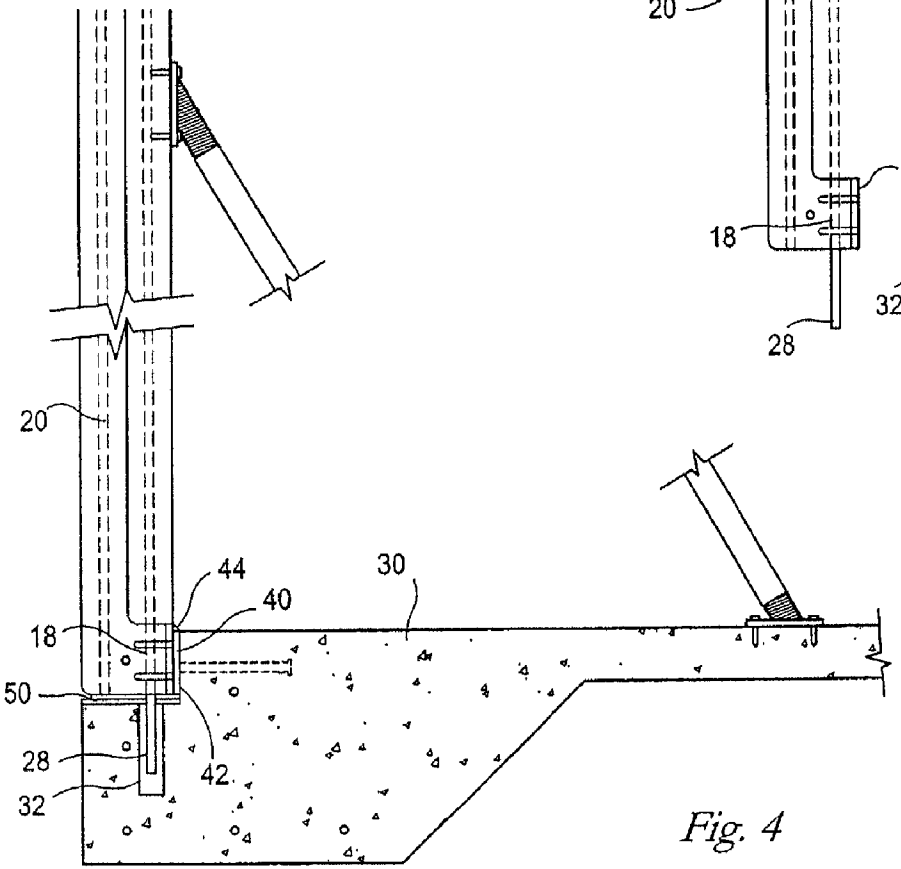
FIG. 4 is a cross sectional side view of the lower portion of the preferred embodiment of the invention in place on a footer.
Figure 6:
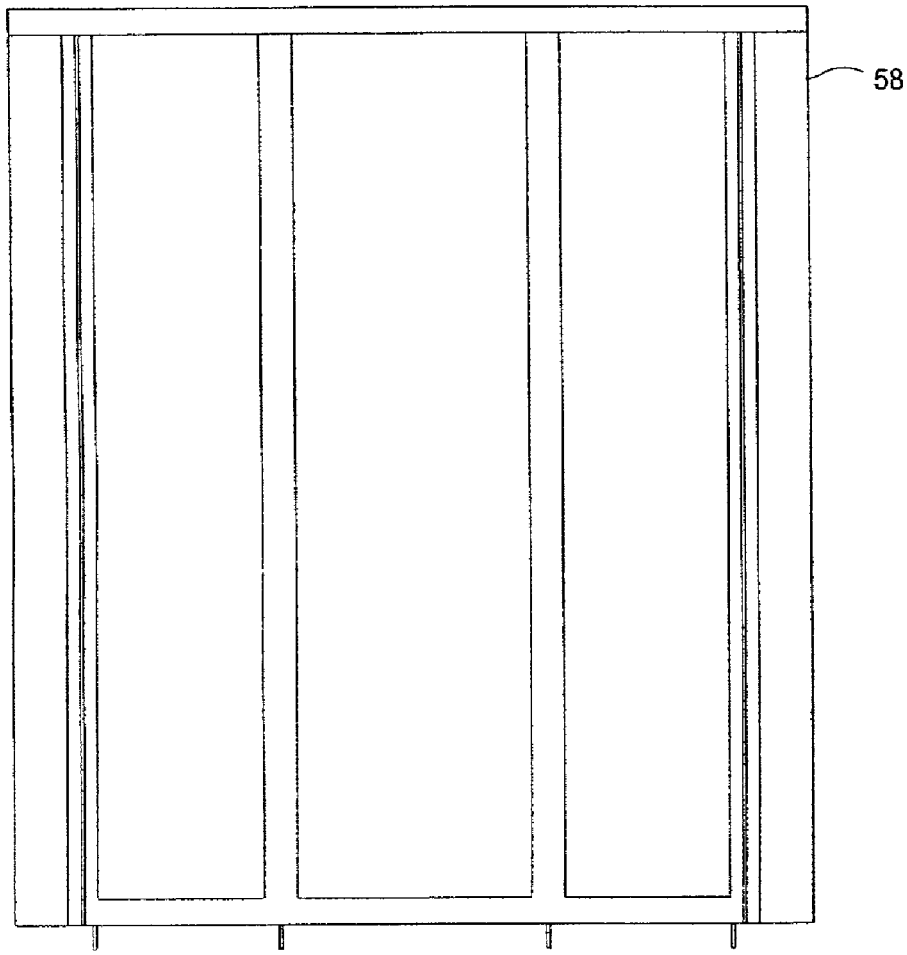
FIG. 6 is a top view of a form for a panel.

For the tilt-up operation, it is critical that the panels 10 are placed correctly. As shown in FIGS. 3 and 4, the panels 10 include a plurality of extensions 28 extending vertically from the bottom side 24 of the panel 10 appropriate for placement of the panel 10 into a footer 30. Each extension 28 fits within a core hole 32 in the footer 30. Preferably, the core hole 32 is approximately two inches in diameter and seven inches in depth. It is also preferred that the extensions 28 are extensions of the inner bars 18 within the columnar supports 16*a*, 16*b*, as shown in FIG. 3. The extensions 28 should be approximately six inches in length.

In one embodiment of the invention, as shown in FIG. 5, at least one plastic insert 34 is placed between two panels 10. The insert 34 is generally shaped to correspond with the chamfer 14 in the side of each panel 10. The insert 34 may be constructed in the form of a pin 34. In the preferred embodiment, the insert 34 is approximately twenty-four inches long. However, the insert 34 may be any length, or extend fully up the length of the wall. It is also preferred that the insert 34 is made from a high-density, high compressive strength plastic. The insert 34 is placed approximately midway up between the panels 10. It is attachable to the panels by a double sticky tape 36 to keep it in place during construction of the structure; however, other methods of attaching the insert 34 to the panels 10 are known, such as an adhesive or epoxy. The insert 34 serves to act as a stabilizer against shear between the panels 10, and also serves to help keep the panels 10 aligned. Moreover, the insert 34 may operate as a gasket where it is approximately the full height of the two panels 10. Furthermore, the insert 34 preferably expands and contracts according to the temperature. Thus the insert 34 acts as an expansion joint between the two panels 10. In addition, the insert 34 may function as a plug for filling material between the panels 10. Material may include epoxy, cement or other material depending upon the qualities desired for the joint between the panels 10. Caulking 38 at the joint keeps filler material in and makes the joint look professionally finished. It may also be desired to have a second insert 34 or pin 34 approximately twenty-four inches from the top of the panels 10 for increased stabilization and a more sure alignment between the panels 10. In another alternative embodiment, a pre-formed joint cover may be used between the panels.

Also, as shown in FIGS. 3 and 4, to further ensure proper and secure placement, a bottom weld plate 40 is tied to the inner reinforcement bar 18 at the bottom portion of the columnar supports 16*a*, 16*b*. The bottom weld plate 40 is then welded to a corresponding plate 42 in the footer. It may then be preferred to provide caulking 44 at the seam between the foot of the panel 10 and the foot of the footer 30.

Figure 7:
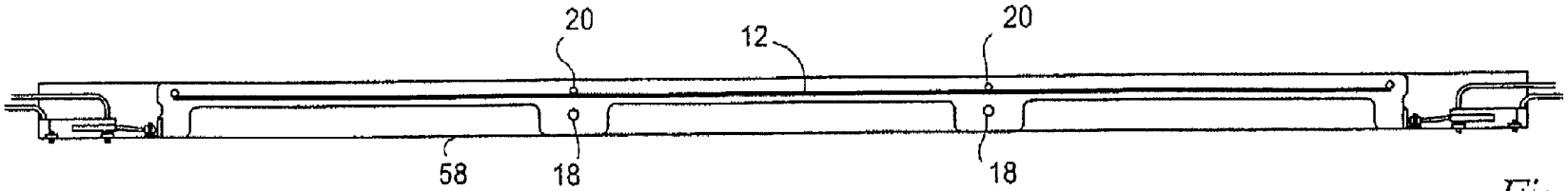
FIG. 7 is a cross sectional view of a form for a panel showing the form attached to a secure surface.
Figure 8:
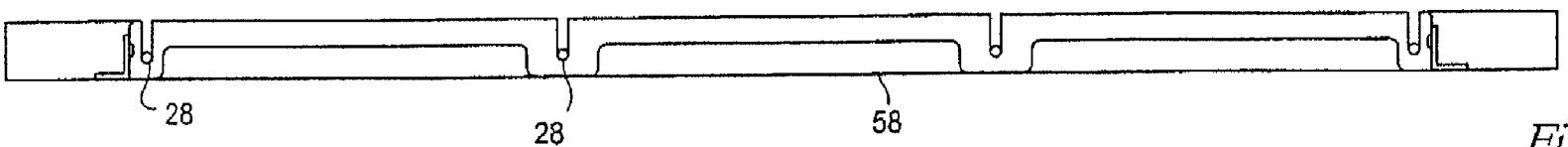
FIG. 8 is a bottom view of a form for a panel.
Figure 9:
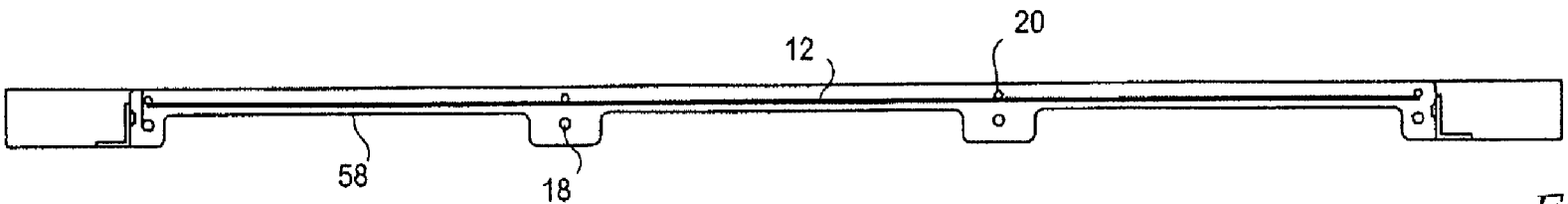
FIG. 9 is a cross sectional view of a form for a panel.

A structure built in accordance with the present invention is preferably made as follows. First panels 10 are formed, each including a plurality of columnar supports 16*a*, 16*b*, extensions below the panel 28, and intrinsic receptacles 40 for a means for lifting the panel 10, such as an eyelet 48. Forms 58 for the creation of the panel are illustrated in FIGS. 6 through 9. FIG. 7 illustrates how the form is secured to a surface during formation of the panels 10. Block-outs 22 formed at the formation of the panel 10 within the form, or may be carved into the columnar supports 16*a*, 16*b* after the panel 10 is formed. As the panel 10 is formed, or after it has cured, any number of facades may be imprinted on or attached to the outer surface of the panels. For example, the concrete may be stamped with a repeating or one-time aesthetic pattern; river rock or other aggregate may be affixed to the panel or liners or channels may be formed onto the outer surface of the panel.

A footer 30 is provided, comprising core holes 32 complementary to the extensions 28 below the panel 10. At least one of the core holes 32 is then filled at least part way with a suitable filling material 52, such as grout, to help form a seal between the panel 10 and the footer 30. The filling material 52 may also be cement, for added strength, or other material, depending upon the structural properties preferred by the builder. It may also be preferable to lay a bed of grout between the rod holes in the footer 30 to create a seal between the panel 10 and the footer 30. Depending upon the grout material, the seal may operate as a seal for water intrusion or an insect barrier, or both. Also, before the panel 10 is placed on the footer 30, shims 50 are preferably placed between the panel and the footer. The shims 50 ensure that the panels 10 are properly aligned. These shims 50 are preferably made of a material of high compressive strength. Also before the panel 10 is positioned, the eyelets 48 are placed in the receptacles 46. The panel 10 is then positioned over the footer 30, using at least one of the extensions 28 and at least one of the eyelets 48. The panel 10 is then placed on the footer 30 so that the extensions 28 are located in the core holes 32 of the footer 30. The extensions 28 displace the filling material 52 in the core holes 32 in the footer 30, so that the filling material 52 forms a seal between the panel 10 and the footer 30. Bracing 54 as known in the art is then added as necessary to temporarily stabilize the structure. Before a second panel 10 is placed, an insert 34 is attached to the panel 10 approximately midway up the panel 10. The insert 34 is attached to the chamfered edge 14 of the first panel 10 by double sided tape 56. The second panel 10 is placed next to the first, in substantially the same manner as the first, in contact with the insert 34. Appropriate filling material, such as caulking epoxy or cement 15, may then be placed over the insert 34. It is preferred that the caulking be in contact with the insert.

Figure 10:
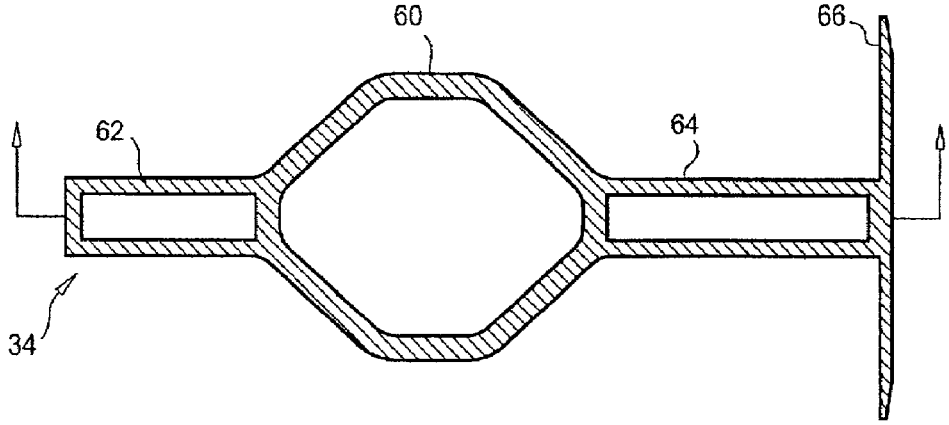
FIG. 10 is a cross sectional view of an alternative embodiment of an insert for placement between panels.
Figure 11:
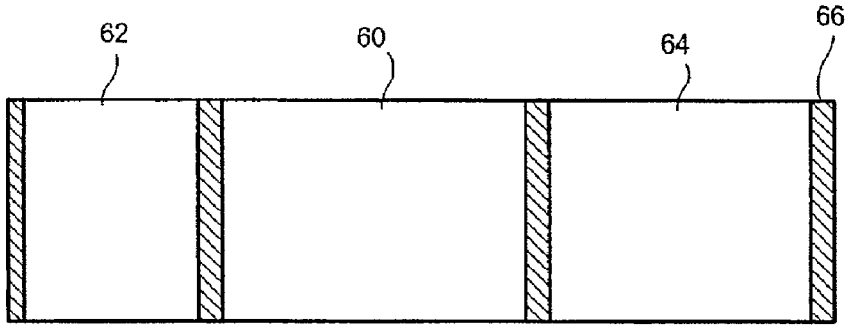
FIG. 11 is a side view of an alternative embodiment of an insert for placement between panels.
Figure 12:
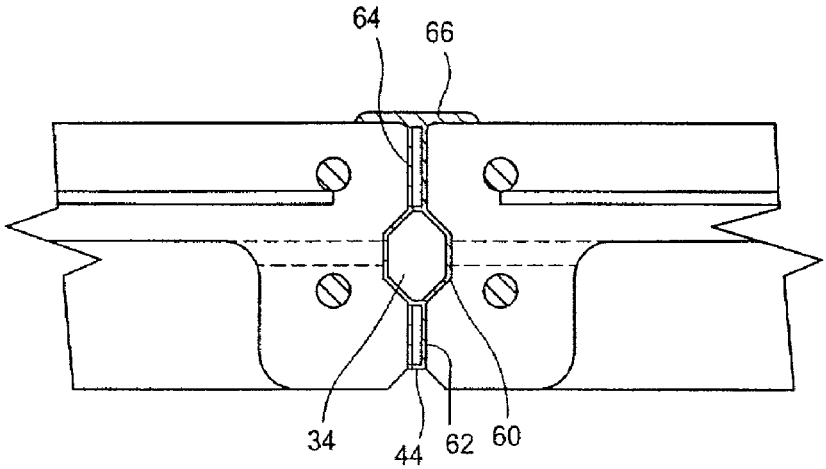
FIG. 12 is a sectional view of an alternative embodiment of an insert in situ between two panels.

In an alternative embodiment, a columnar insert 34 is used, shown in FIGS. 10 through 12. In this embodiment, the insert is preferably hollow. The insert 34 has a central faceted portion 60, connected to an inner arm 62 and an outer T-shaped form 64. The insert 34 is placed between two panels 10 so the inner arm 62 is on the same side as the inner side of the panels 10 and the outer form 64 is on the outer side of the panels. The insert 34 is placed so the outer forms 64 are located outside the panels 10 as shown in FIG. 12. Thus, caulking 44 is only needed between the outside surface of the panels, and may be preferred between the insert and the chamfered edges of the panels 10. As shown in FIG. 10, it is preferred that the faceted portion 60, the inner arm 62 and the base of the outer form 64 are hollow. However, they may also be made solid throughout.

The invention claimed is:

1. A panel having intrinsic columnar support and intrinsic means for facilitating placement of the panel for tilt-up wall construction of a high strength structure, comprising:

a concrete construction panel, including means for securing the panel to a single element footer located at the bottom of the panel;

a plurality of intrinsic columnar supports in each panel, comprising means for reinforcing the supports centrally located within the supports, wherein said means for reinforcing the supports terminate in one or more straight-ended generally vertical rod members for placement in complementary voids in the footer, said rod member is adapted for welding attachment to the footer, and said footer allowing voids that correspond to one or more ends coming out of a bottom portion of one or more wall panels to be pre-drilled into the footer; and means for facilitating the placement of the panels in cooperative connection with the means for reinforcing the supports, wherein the means for reinforcement comprises a plurality of vertical reinforcement bars, wherein the means for securing the panel comprises a horizontal structural weld plate on an inside face of the bottom portion of the panel, and an extension of at least a portion of the vertical reinforcement bar below the bottom of the panel, whereby welding of the weld plate to the footer provides structural reinforcement of the panel.

2. The panel of claim 1, wherein the extension of the vertical reinforcement bar comprises approximately six inches of a number 8 reinforcement bar.

3. The panel of claim 1, wherein the panel further comprises one or more weld plates located generally at the top of the intrinsic columnar supports.

4. The panel of claim 2, wherein the means for facilitating is located approximately two-thirds up the height of the panel.

5. The panel of claim 4, wherein the means for facilitating is at least one receptor for a lifting eyelet, whereby the panel is positioned by a means for lifting the panel using the extension of the reinforcement bar and at least one lifting eyelet located within the receptor as lifting points.

6. A method for building a tilt-up wall structure, comprising the steps of:

forming a first panel and a second panel, each panel comprising:

at least one chamfered side; and a plurality of straight reinforcement bar extensions at intervals on the bottom of each panel;

providing at least one monolithic footer;

filling one or more holes in the footer with grout; and placing each panel on the footer so that the extensions are located within the holes, said footer allowing voids that correspond to the extension coming out of the bottom of the panels to be pre-drilled into the footer;

further comprising the step of:

placing at least one pin on a side of the first panel;

placing the second panel adjacent to the pin; and filling space formed between the first panel and the second panel above the pin with an appropriate material.

7. The method of claim 6, wherein the first panel and the second panel each further comprise metal plates located at least approximately halfway up the chamfered side, further comprising the step of welding the plates together before the step of filling the space.

8. The method of claim 7, further comprising the step of caulking the space between the first panel and the second panel after the step of welding the plates.

9. The method of claim 6, wherein the pin comprises a material of high compressive strength.

10. The method of claim 6, wherein the approximate material comprises at least one of the following group: epoxy, caulk and grout.

11. A method for building a tilt-up wall structure, comprising the steps of:

forming a first panel and a second panel, each panel comprising:

at least one chamfered side; and a plurality of straight reinforcement bar extensions at intervals on the bottom of each panel;

providing at least one monolithic footer with holes complementary to the extensions;

filling the holes with grout; and placing each panel on the footer so that the extensions are located within the holes, further comprising the step of:

placing at least one pin on a side of the first panel;

placing the second panel adjacent to the pin; and filling space formed between the first panel and the second panel above the pin with an appropriate material.

12. The method of claim 11, wherein the first panel and the second panel each further comprise metal plates located at least approximately halfway up the chamfered side, further comprising the step of welding the plates together before the step of filling the space.

13. The method of claim 12, further comprising the step of caulking the space between the first panel and the second panel after the step of welding the plates.

14. The method of claim 11, wherein the pin comprises a material of high compressive strength.

15. The method of claim 11, wherein the appropriate material comprises at least one of the following group: epoxy, caulk and grout.

* * * * *